US005175927A

United States Patent [19]

Coniff

[11] Patent Number: 5,175,927

[45] Date of Patent: Jan. 5, 1993

[54] METHOD OF FORMING ELECTRICAL CONTACT/TERMINAL

[75] Inventor: John B. Coniff, Hoffman Estates, Ill.

[73] Assignee: Eaton Corporation, Cleveland, Ohio

[21] Appl. No.: 769,694

[22] Filed: Oct. 2, 1991

[51] Int. Cl.[5] ..... H01R 43/16

[52] U.S. Cl. ..... 29/874; 29/414

[58] Field of Search ..... 29/874, 412, 413, 414, 29/415; 439/733, 83, 84, 741, 870, 873, 885

[56] References Cited

U.S. PATENT DOCUMENTS 3,675,320 7/1972 Watanabe ..... 26/630 D
4,206,964 6/1980 Olsson ..... 29/874 X
4,330,168 5/1982 Arnold ..... 339/276 T
4,466,689 8/1984 Davis et al. ..... 29/874 X
4,546,542 10/1985 Proud ..... 29/874
5,082,460 1/1992 Legrady ..... 29/874 X

*Primary Examiner*—Timothy V. Eley
*Attorney, Agent, or Firm*—R. A. Johnston

[57] ABSTRACT

A flat strip of conductive material is formed by extrusion with an integrally formed thickened or flanged portion along at least one longitudinal edge of the extrusion. Individual contact/connector terminals are then stamped from the extrusions with the flat portions forming the blade of the connector terminal and the thickened flanged portion forming a head on the blade which provides the integrally formed contact surface.

7 Claims, 2 Drawing Sheets

METHOD OF FORMING ELECTRICAL CONTACT/TERMINAL

BACKGROUND OF THE INVENTION

The present invention relates to methods of forming a combination electrical contact/terminal of the type employed in electrical switching mechanisms to provide for making and breaking of a circuit, and for external electrical connection to the switching mechanisms. The present invention relates particularly to contact-/terminals of the type having a flat blade type external electrical terminal for connection to a mating electrical connector, for example, of the multiple pin type employed in an automotive wiring harness. Terminals of this type are typically pressed into the switch housing with the blade portion of the contact terminal extending exteriorly of the switch housing for external connection thereto and the contact portion disposed interiorly of the switch housing. Barbs can be formed on the blade portion to prevent unwanted movement of the installed contact/terminal in the housing.

It is known to manufacture such switch contact/terminals by shaping a flat strip of conductive material to form a thickened portion along one edge as, for example, by rolling or machining material from the flat strip and then cutting or stamping individual terminals from the strip. These processes, however, require the set up for and performance of the additional manufacturing operations of rolling or machining, and are thus quite costly in high volume mass production of contact/terminals for switches. Therefore, it has been desired to find a simplified and low-cost way or technique for fabricating individual bridge contact/terminals of the type having a terminal blade for extending exteriorly of the switch with a switch contact surface provided on a thickened head portion of a blade.

SUMMARY OF THE INVENTION

The present invention provides a unique and novel method of forming a combined one-piece or unitary electrical connecting terminal and switch contact of the type wherein the connecting terminal has a flat blade configuration with an enlarged head portion with the contact face provided thereon. The individual unitary contact terminals are cut or stamped from an extruded flat strip of electrically conductive material having a thickened portion along one longitudinal edge of the extrusion. The strip is cut transversely such that the length of the cut off piece in the longitudinal direction of the extrusion becomes the width of the electrical connector blade; and, the cutoff portion of the thickened edge becomes the head of the terminal with the contact face formed thereon. In one embodiment, the extruded strip has a thickened portion along one longitudinal edge and the terminals are cut therefrom all with the same orientation. In another embodiment, the strip is extruded with thickened portions along opposite longitudinal edges, and the terminals are cut from the strip in staggered arrangement with the head portion formed oppositely oriented on adjacent cut portions.

DETAILED DESCRIPTION

Figure 1:
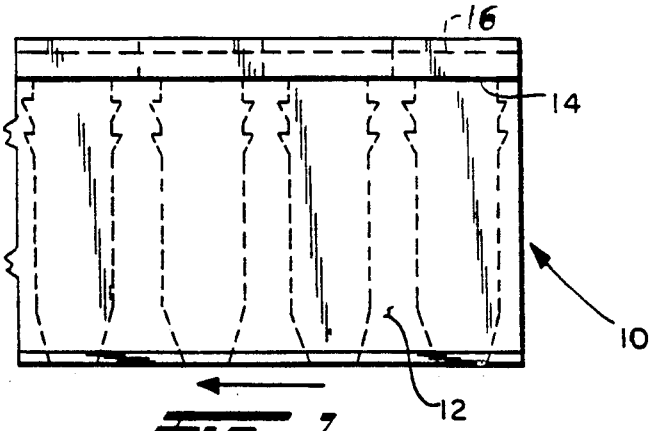
FIG. 1 is a plan view of an extruded flat strip having a thickened portion along one longitudinal edge thereof.
Figure 2:
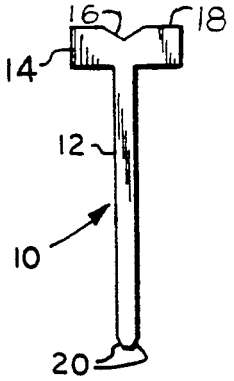
FIG. 2 is an end view of the extrusion of FIG. 1.

Referring to FIGS. 1 and 2, the extruded flat strip indicated generally at 10 has a flat portion 12 generally thin with respect to its width and with a thickened flange portion 14 along one longitudinal edge thereof in the direction of the extrusion indicated by the black arrow in FIG. 1, with the flange 14 forming a generally "T"-shaped configuration in cross-section as shown in FIG. 2. The flange portion has a groove 16 formed on the outer face thereof which, as will hereinafter be described, facilitates the use of the outer face 18 of the flange 14 as an electrical contact surface for making and breaking circuits. The edge of the strip 10 opposite the flange 14 is chamfered on both sides as denoted by reference numeral 20 in the extruding operation, to facilitate later installation and electrical connection operations. In the presently preferred practice the extrusion 10 is formed of an electrically conductive grade of brass, copper, or copper alloy material.

Referring to FIGS. 1, 3, 4, and 7, individual unitary or one-piece electrical contact/connector terminals 30 are cut or severed from the strip 10 from patterns as indicated by the dashed outlines shown in FIG. 1. The adjacent sides of the flange or head portion 14' of each individual connector denoted by reference numeral 30 in FIGS. 3, 4, and 7 have a blade portion 12' formed from the flat portion 12 of strip 10, and a generally square head portion 14' formed from the edge flange 14 of the strip 10. Each head portion 14' has a portion 16' of the V-shaped grooved provided on the outer face of the head. In the presently preferred practice, a second V-shaped groove 32 is provided in the face of the head 14' and is oriented at right angles to the groove 16' and also functions to facilitate wiping surfaces on the outer face of the head portion 14' when employed as an electrical contacting surface for making and breaking a circuit with an adjacent movable contact (not shown).

Figure 3:
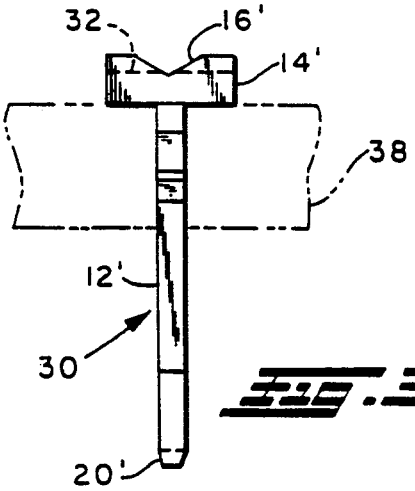
FIG. 3 is a view similar to FIG. 2 of an individual electrical contact/terminal cut from the strip of FIG. 1.
Figure 4:
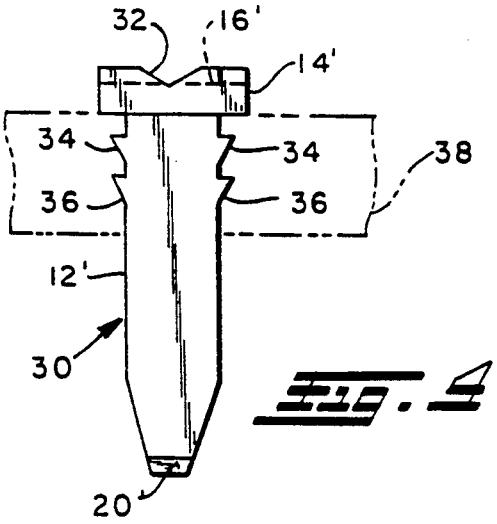
FIG. 4 is a plan view of the individual terminal of FIG. 3.
Figure 7:
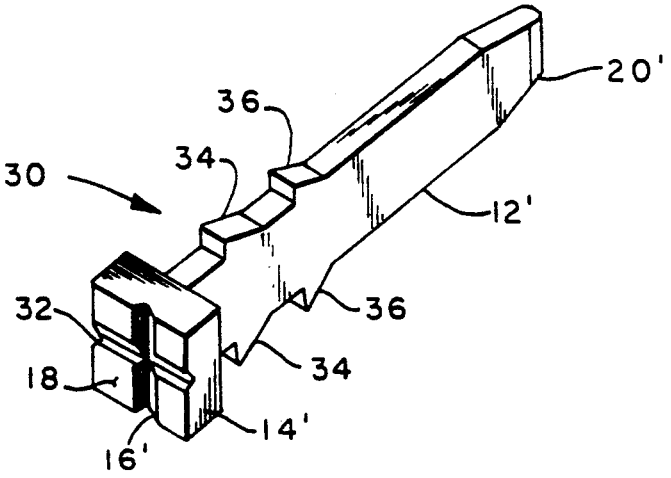
FIG. 7 is a perspective view of the terminal of FIGS. 3 and 4.

In the presently preferred practice, the blade portion 12' of the contact/connector terminal 30 is formed as cut from the strip 10 with a plurality of barbs 34,36 provided on opposite sides or edges of the blade portion 12' and spaced closely adjacent the undersurface of head portion 14'. The barbs 34,36 serve to retain the terminal in a switch housing 38 when inserted in an aperture therethrough. A portion of such a switch housing is shown in dashed outline in FIGS. 3 and 4, and is indicated by reference numeral 38. The chamfered portion 20 of the edge of the extruded strip 10 forms the beveled edges 20' of the contact/terminal blade 12' as illustrated in FIGS. 3, 4, and 7.

Figure 5:
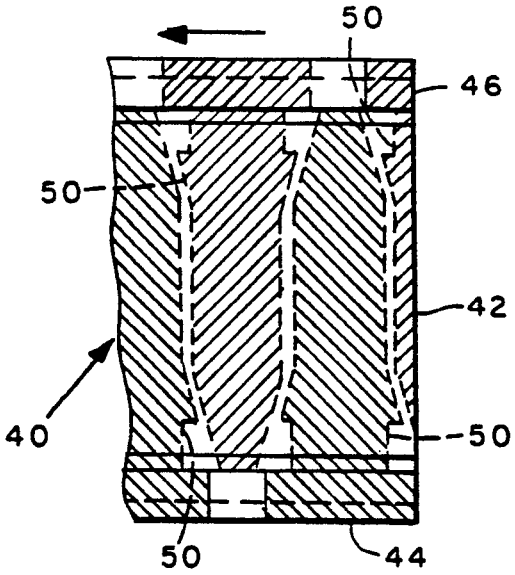
FIG. 5 is a plan view of an alternate embodiment of the present invention, employing an extrusion having thickened edge portions on opposite longitudinal edges.
Figure 6:
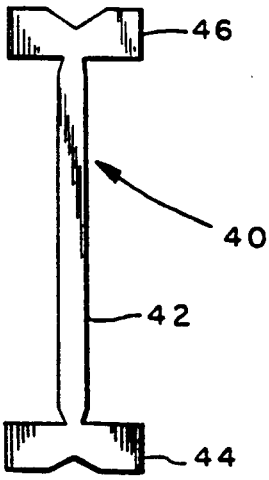
FIG. 6 is an end view of the extrusion of FIG. 5.
Figure 8:
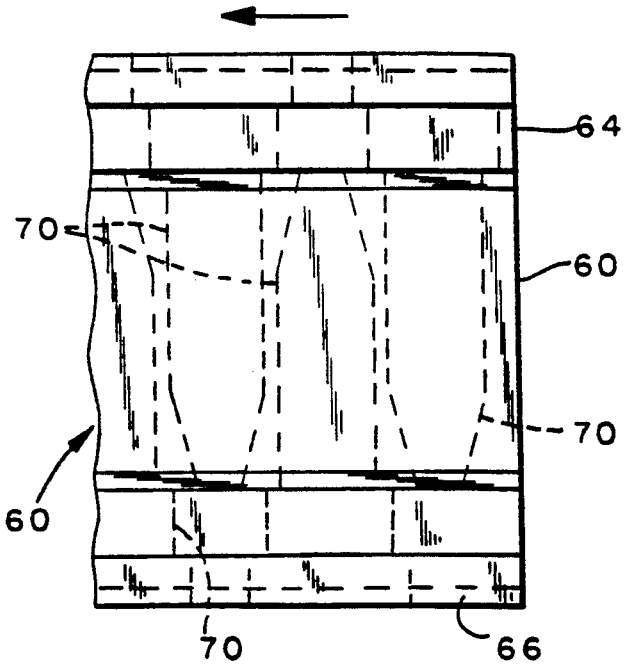
FIG. 8 is a view similar to FIG. 5 of an extrusion of another embodiment of the invention.

Referring to FIGS. 5 and 6, another embodiment of the invention is illustrated, wherein an extrusion indicated generally at 40, and formed of electrically conductive material, is elongated in a direction indicated by the black arrow in FIG. 8, and has a generally thin, flat central portion 42 with both opposite longitudinal edges of the extrusion formed to a thickened configuration similar to that of FIGS. 1 and 2 as denoted by reference numerals 44,46.

Referring to FIG. 5, individual contact/connector terminals indicated by reference numeral 50 and arranged in an oppositely disposed staggered arrangement, as shown by the dashed outline are cut from the strip 40. It will be understood that in such arrangement, adjacent terminals in the direction of extrusion are formed or cut as having the head portion thereof formed alternately from opposite ones of the thickened edge flanges 44,46 to optimize the use of the material of the extrusion.

Figure 9:
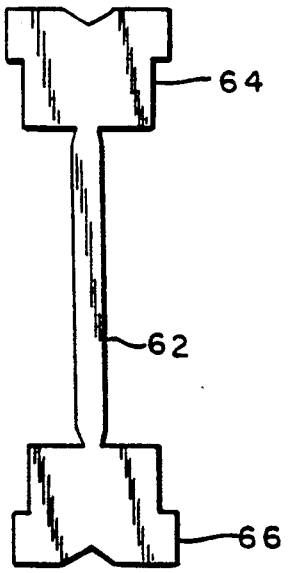
FIG. 9 is an end view of the extrusion of FIG. 8.

Referring to FIGS. 8 and 9, another embodiment of the invention is illustrated, wherein an extrusion indicated generally at 60 has a generally thin, flat central section 62 and the longitudinal edges thereof to a thickened generally square configuration, as denoted by reference numerals 64,66. In the embodiment of FIGS. 8 an 9, individual terminals are laid out as shown in dashed outline in FIG. 8 and denoted by reference numeral 70. Adjacent terminals in the direction of extrusion are oriented in oppositely disposed arrangement such that the heads thereof are formed alternately from the flanges 64,66 to optimize utilization of the material of the extrusion.

In the presently preferred practice of the invention, the individual terminals 30,50,70 are cut from their respective strips 10,40,60 by die stamping, although it will be understood that other techniques of severing the individual connectors from the strips may be employed.

The present invention thus provides a unique and novel method of manufacturing individual electrical contact/connector terminals for installation in electrical switches by extruding a generally flat strip having at least one longitudinal edge thereof thickened and then cutting individual unitary contact/terminals from the strip, with the thickened edge portion providing the head of the contact/terminal upon which the face thereof is formed as an electrical contact surface. The blade portion is preferably formed as barbed to aid retention upon installation.

Although the invention has hereinabove been described with respect to the illustrated embodiments, it will be understood that the invention is capable of modification and variation, and is limited only by the following claims.

I claim:

1. A method of making an electrical switch contact/-connector terminal comprising the steps of:

(a) extruding a generally flat strip of conductive material of uniform thickness having at least one longitudinal edge flanged;

(b) cutting said strip and flange into desired lengths for forming individual terminals of desired width and forming at least one barb on opposite sides of said cut length; and (c) forming a recess in said flanged edge and forming an electrical contact surface thereon.

2. The method defined in claim 1, wherein said step of cutting includes the step of forming at least one barb on opposite edges of said cut length.

3. A method of making an electrical switch contact-/terminal comprising the steps of:

(a) extruding a flat strip of electrically conductive material having a central web width flange formed on opposite longitudinal edges thereof;

(b) severing the web of said strip and forming a plurality of elongated portions thereof, each having only one flange thereon; and, forming retention surfaces on the edges of said severed portions.

4. The method defined in claim 3, wherein said step of forming retention surfaces includes forming barbs on opposite edges of said elongated portion.

5. The method defined in claim 3, wherein said severing includes alternately forming said one flange from opposite sides of said "T"-shaped section.

6. A method of making an electrical switch contact-/terminal comprising the steps of:

(a) extruding a strip of conductive material with a generally "T"-shaped transverse section;

(b) severing said strip into desired lengths for forming a plurality of terminals of the width of said length;

(c) forming a recess in the head of said "T"-shape to create a contact surface; and, (d) forming retention surfaces on the edges of the stem of said "T"-shape.

7. The method defined in claim 6, wherein said severing comprises die stamping.

* * * * *